US006112935A

United States Patent [19]

Shackelford

[11] Patent Number: 6,112,935

[45] Date of Patent: Sep. 5, 2000

[54] CATCH BASIN

[75] Inventor: George Shackelford, Riverside, Calif.

[73] Assignee: Normandy Products Company, Verona, Pa.

[21] Appl. No.: 09/357,648

[22] Filed: Jul. 20, 1999

[51] Int. Cl.[7] ..... B65D 88/76

[52] U.S. Cl. ..... 220/484; 220/560.03; 220/567.1; 220/675; 52/169.5

[58] Field of Search ..... 220/484, 560.03, 220/567.1, 672, 675, 676; 52/169.5, 660, 220.5

[56] References Cited

U.S. PATENT DOCUMENTS

| | | | |
|---|---|---|---|
| 3,002,650 | 10/1961 | Lovell | 220/675 |
| 3,009,603 | 11/1961 | Stockdale | 220/675 |
| 3,077,284 | 2/1963 | McLaughlin | 220/675 |
| 3,307,739 | 3/1967 | Cloyd et al. | 220/675 |
| 3,741,815 | 6/1973 | Peterson | 220/484 |
| 4,065,020 | 12/1977 | Carson | 220/484 |
| 4,163,503 | 8/1979 | McKinnon | 220/484 |
| 4,553,874 | 11/1985 | Thomann et al. | 52/169.5 |
| 5,535,915 | 7/1996 | McKinnon | 220/484 |

*Primary Examiner*—Paul T. Sewell
*Assistant Examiner*—Troy Arnold
*Attorney, Agent, or Firm*—Donald D. Mon

[57] ABSTRACT

A catch basin for below-grade installations to receive water through a grate, and which can be adapted to receive and discharge water through a plurality of inlet ports, and be able to withstand heavy bearing loads without collapse of the basin or of its grate, especially one manufacturable by rotational molding.

4 Claims, 2 Drawing Sheets

CATCH BASIN

FIELD OF THE INVENTION

A catch basin for below-grade installations to receive water through a grate, and which can be adapted to receive and discharge water through a plurality of inlet ports, and be able to withstand heavy bearing loads without collapse of the basin or of its grate, especially one manufacturable by rotational molding.

BACKGROUND OF THE INVENTION

Catch basins are widely used for the collection of drainage water from various sources. They are placed below grade so as to receive gravity flow. Customarily they have an open top that is closed by a rigid grate which often is subject to heavy bearing loads such as from vehicles which ride over the grate. The grate in turn transmits the load to the catch basin structure itself through the rim of the basin. The structural problem is complicated by the fact that the walls of the catch basin are usually weakened by openings through them that are provided to receive and to pass water received from the grate and from conduits connecting the basin to some other source or destination.

Catch basins and their grates have generally been made from materials of general use in the construction industry, such as concrete for heavy walls and steel for strong grates. Organic plastic materials have many properties which should recommend them for use in catch basins, such as lightness of weight, convenience in installation, and ultimate lesser installed cost. However, the shapes required for the function and load-resisting properties of the catch basin with the use of organic plastics have not previously been economically attainable with conventional casting and molding techniques. This is especially the situation for larger part sizes of 18–24 inches across.

Conventional processes require male and female mold parts. These cannot form integral structures having shapes that will withstand the loads because they generally preclude the removal of the male mold portion. Such shapes can be made from a plurality of cast or molded parts, but then these must be joined together, and there are inherent discontinuities where they are joined by various techniques, all of which involve cost.

In addition, the costs of the conventional mold parts themselves, and the machinery required to use them, are very large. If a catch basin made of organic plastic material is to be made economically and structurally satisfactorily, a different process must be used.

One such process is rotational molding. Because its only requirement is that all surfaces, both internal and external, be defined by the inside wall of a closed mold, the cost of the mold is dramatically reduced in comparison with a two or more piece mold with both male and female portions, and often at least several pull axes. It does, however, require a resourceful product design to withstand the loads, and which can be formed only by reference to the inside wall of a mold.

Evidently there will be a separation line in the rotational molding process so the rotational mold can be opened, but when it is opened, a complete single piece remains. The process itself involves rotating the mold around two or more axes in a mold which is heated from the outside. The proper amount of solid granular plastic material is placed in the mold, and as it is heated and rotated, a layer of material is deposited and cured on the inside wall, which ultimately constitutes the product. The thickness of the wall is established by the amount of plastic material that is used.

It is an object of this invention to provide a catch basin made of one continuous body of organic plastic which will withstand heavy bearing loads exerted by an overlaying grate, and which can be manufactured by a straight-forward and economical rotational molding process.

BRIEF DESCRIPTION OF THE INVENTION

A catch basin according to this invention has a bottom, a plurality of peripheral side walls, and a top with a central opening. These form an internal basin to receive water. The catch basin is shaped as a unitary structure which can be manufactured in a single piece by rotational molding techniques.

The shape of the catch basin includes a rim to receive and support a grate. The grate will be perforated to pass water and retain trash. The wall of the catch basin structure is stepped along its vertical dimension to provide for more effective rotational molding, to provide for incremental external support from the surrounding material in which the catch basin is sunk, and to provide a stackable product.

The rigidity of the structure is sufficient that openings can be formed in the sidewalls to receive conduits through which water can pass to and from the basin.

The above and other features of this invention will be fully understood from the following detailed description and the accompanying drawings, in which:

DETAILED DESCRIPTION OF THE INVENTION

Figure 1:
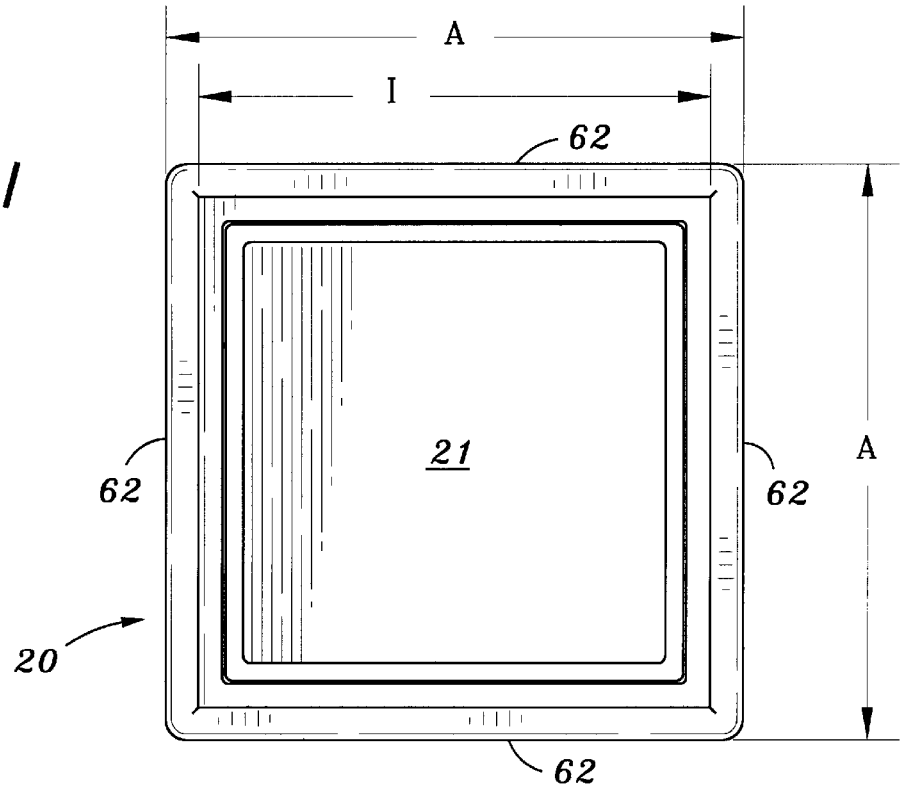
FIG. 1 is a top view of the presently preferred embodiment of the invention.

The presently preferred embodiment of the invention is shown in the drawings. It is a unitary structure, prepared by the rotational molding process. An organic plastic material in granular form is introduced into the mold cavity, and the mold is externally heated while being rotated around a plurality of axes so as to deposit a continuous layer of plastic on the interior surface of the mold. The layer is cured in place to form the product. The outside surfaces of the catch basin are formed by the inside surfaces of the mold. The wall thickness is made constant by proper operation of the casting equipment and is established by the amount of plastic placed in the mold.

The rotational molding process is well-known to persons skilled in that art. An understanding of this art is not necessary to an understanding of this invention, and it will not be described in detail here. The parameters of the plastic composition, its viscosity, temperature ranges for curing, rotational orientations and velocities are well within the skills of the artisan in this field. What is important to this invention is appreciation of the importance of the use of this process to create the complex structure which is the subject of this invention. The inventor herein is unaware of any other casting or molding process that can create the complicated shapes of the structure of this invention as a unitary body with a substantially constant wall thickness over its entire area, and especially with economical tooling.

The resulting structure is seamless. It provides surface areas adaptable to having an aperture punched in them to receive a conduit, and ledges and shoulders to provide additional rigidity and means for external support.

Catch basin 20 has a flat bottom 21 and a generally rectangular, preferably square, horizontal cross-section. A first peripheral sidewall 22 is a band formed from four rectangular panels 23, 24, 25, 26.

A second peripheral sidewall 30 is a band formed from four rectangular panels 31, 32, 33, 34. Their horizontal dimension is larger than that of panels 23–26, so as to form an inside step 36 and an outside overhang 37.

A third peripheral sidewall 40 intersects the second peripheral sidewall 30 in a different manner. There are four such panels 41, 42, 43, 44, but their intersections with the second peripheral sidewalls and their shapes are quite different.

Figure 2:
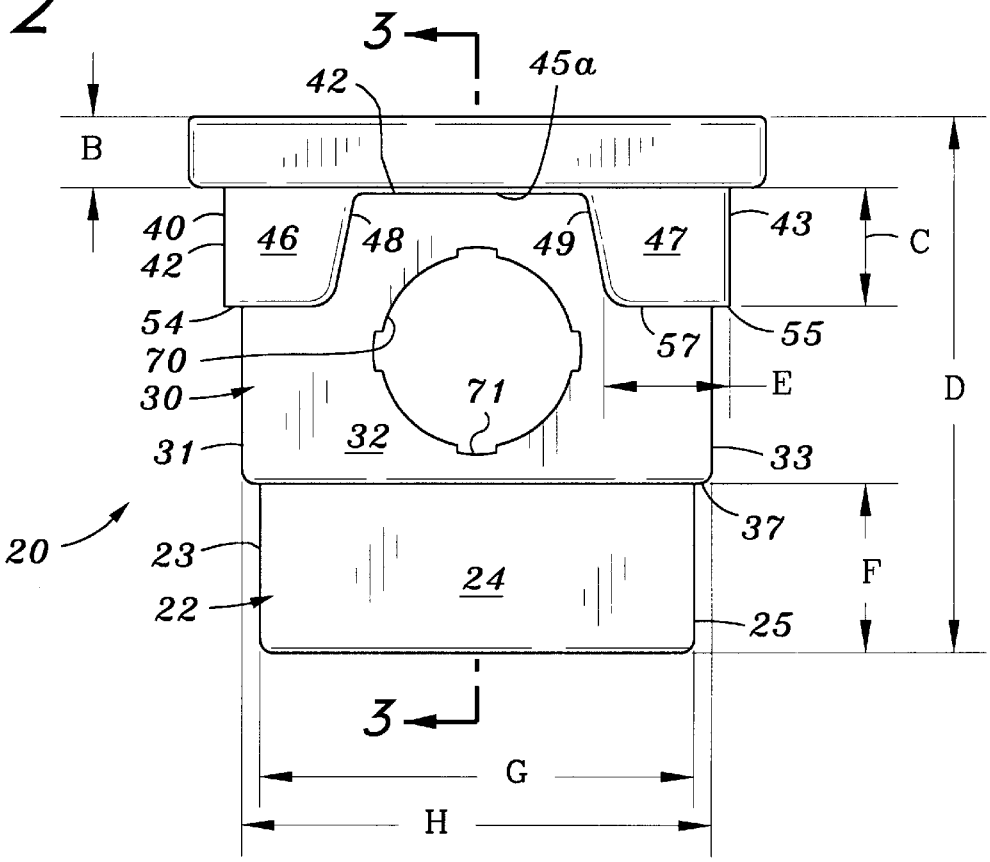
FIG. 2 is a side view of FIG. 1, all sides being alike.

Sidewall 40 is a band formed from panels 41–44 which extends from corner to corner. Its horizontal dimension is larger than that of the panels in the second peripheral sidewall. Downwardly extending pads 46, 47 (FIG. 2) extend downwardly adjacent to and including each of the corners. They are all identical, are substantially planar, and lie in the same plane on each face. They have sloping inward edges 48, 49 and bottom edges 50, 51. Adjacent pads join to form an inside recess at the corners with inside bottoms and outside overhangs 54, 55. The central portion 45*a* has a lesser height than the pads at each of its ends.

Figure 3:
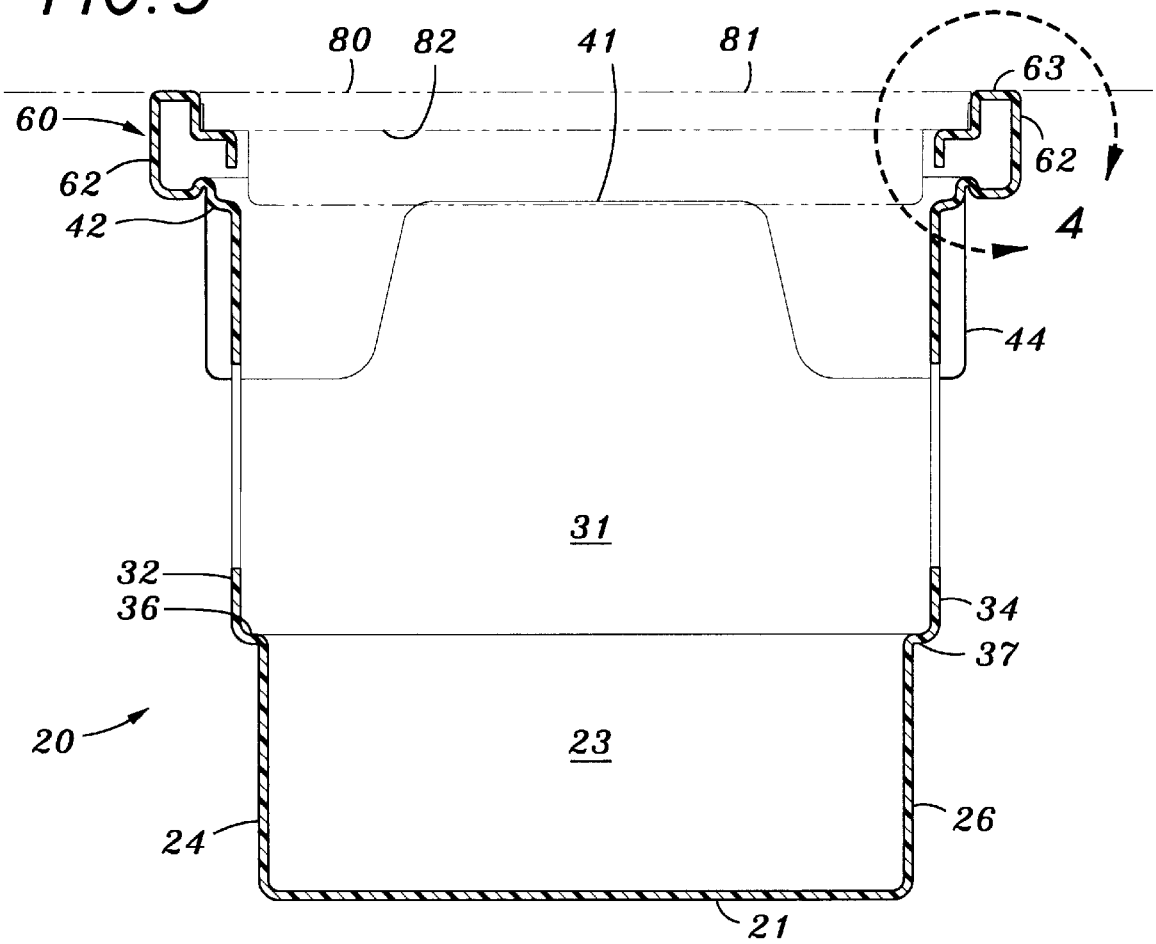
FIG. 3 is a cross-section taken at line 3—3 in FIG. 2.
Figure 4:
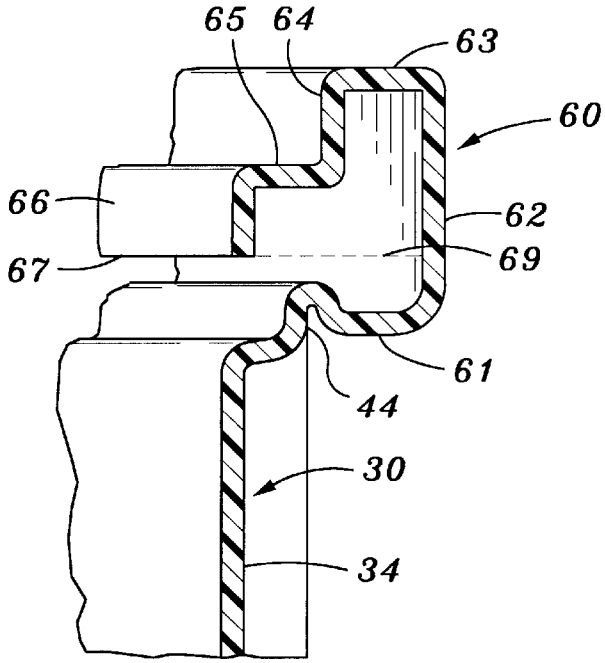
FIG. 4 is a detailed enlarged section taken at section 4 in FIG. 3.

With reference to FIG. 3, an overhanging rectangular collar 60 joins at its lower edge to the upper edge of upper third band 40, i.e. to the upper edges of panels 41–44. Its cross-section (FIG. 4) includes a transition section 61 which extends outwardly to outer panels 62. An upper bearing surface 63 joins outer panels 62.

A downwardly extending surface 64 joins to a flat upwardly facing step 65. A downwardly turned termination flange 66 ends at a lower edge 67. The box-like group of panel 62, surfaces 63, 64 and step 65 form a stiff collar and strong support for the grate.

The region inside this cross-section opens into the center of the basin. Depending on how the mold is rotated it is possible that a web (not shown) will be formed partly or entirely across edge 67. If so, it is merely trimmed away and discarded.

All corners and edges are appropriately rounded. The ledges and steps are flat. The wall thickness of the entire structure is substantially uniform. The corners meet at right angles, and are mitered. The entire structure defined to this point is unitary and continuous, cast by rotational molding in a continuous piece. As shown, it can be removed from a conventional rotational mold after the mold is opened. The parting line 69 of the mold extends around panels 62 which is the place where the two parts of the closed mold (not shown) close against one another. The inside mold surface is the precise reverse of the outside of the basin which it forms.

If desired, openings 70 can later be cut in the panels of the second peripheral wall to receive conduits that discharge water into the basin, or to convey water from it. Key-ways 71 can be formed in the edges of the openings to pass flanges which can be turned to form a lock with the panel.

A grate 80 is shown in phantom line in FIG. 3. It is rectangular with a cap surface 81 that is slotted to pass water and retain some trash. A peripheral shoulder 82 overhangs bearing face 63 and rests against it.

This grate is made strong enough to resist loads intended to be exerted on it. The abutting surfaces of the basin structure can receive and resist these loads. Any deflection is minimized by the hoop-type strength of the basin's upper end. The downward forces transmitted to the walls are resisted by the strength of the wall material as reinforced by the peripheral shoulders, and by the side support of the material in which the basin is placed for example, earth, gravel or concrete, and by skin friction.

The sidewalls of the catch basin will be made as upright as possible, but as in any casting or molding process, some angular draft will be provided to facilitate removal of the product from its mold. Only a few degrees of draft are necessary, and they will be minimized by persons skilled in the art. This also enables the device to be made stackable.

The illustrated structure is self-bracing and inherently rigid. The steps, overhangs, and pads provide not only for a smooth distribution of bearing forces, but the outside overhangs assist in transfer of the loads to surrounding material such as soil or concrete by bearing downwardly on the surroundings. The surroundings themselves will also further resist any tendency of the peripheral walls to bulge outwardly.

The organic plastic material will be selected for its resistance to the environment in which it is to be placed, as well as for its suitability for rotational molding and inherent strength. The presently-preferred organic plastic is polyethylene or polypropylene.

Suitable dimensions, in inches for a nominally 18 inch square catch basin are as follows with reference to the drawings:

| | |
|---|---|
| A - 19.00 | F - 5.75 |
| B - 2.00 | G - 14.00 |
| C - 4.00 | H - 14.75 |
| D - 18.00 | I - 17.25 |
| E - 3.50 | |

This invention is not to be limited by the embodiment shown in the drawings and described in the description, which is given by way of example and not of limitation, but only in accordance with the scope of the appended claims.

I claim:

1. A catch basin comprising a unitary single-piece body formed by a rotational molding process and having a substantially uniform wall thickness throughout, said catch basin comprising the following structural elements:

a rectangular flat bottom;

a first peripheral sidewall comprising a first band of four substantially flat first panels continuous with the bottom and with each other, said first panels having an upper edge;

a second peripheral sidewall comprising a second band of four substantially flat second panels continuous with each other, said second panels each having an upper edge and a lower edge;

a shoulder forming an inside step and an outside downwardly-facing overhang, the upper edges of the first panels and the lower edges of the second panels being continuous with said shoulder;

a third peripheral sidewall comprising a third band of four third panels, and each said third panel having an upper edge and a lower edge, said upper edges of the second panels being continuous with the lower edges of the third panels, said lower edges of the third panels defining a downwardly extending pad at each side of the lower edges with a central portion of a lesser vertical dimension between said pads, said upper band having a greater length than said second panels, said pads thereby forming an inside step and an outside overhang, adjacent said pads being continuous with one another; and a peripheral collar continuous with said upper edges of said third panel, said collar having an outwardly extending shoulder, a peripheral upright band, an overhanging upwardly facing bearing surface, and an internal step, thereby forming an opening to receive a portion of a grate, and a bearing surface on which a portion of said grate can rest.

2. A catch basin according to claim 1 in which an opening is formed in at least one of the second panels after said panel is formed, to receive a conduit.

3. A catch basin according to claim 2 in which said opening includes key ways to engage keys on an engaging conduit.

4. A catch basin according to claim 1 in which said step includes a downwardly extending termination flange.

* * * * *